US010159309B2

(12) United States Patent
Cai et al.

(10) Patent No.: US 10,159,309 B2
(45) Date of Patent: Dec. 25, 2018

(54) VAMP WITH LOOP PROTECTION EYELETS AND MANUFACTURE METHOD THEREOF

(71) Applicant: Sincetech (Fujian) Technology Co., Ltd., Jinjiang, Quanzhou, Fujian (CN)

(72) Inventors: Qinglai Cai, Fujian (CN); Weixiong Shi, Fujian (CN); Le Chen, Fujian (CN); Yizhen Cai, Fujian (CN); Fang Lin, Fujian (CN)

(73) Assignee: SINCETECH (FUJIAN) TECHNOLOGY CO., LTD., Fujian (CN)

( * ) Notice: Subject to any disclaimer, the term of this patent is extended or adjusted under 35 U.S.C. 154(b) by 134 days.

(21) Appl. No.: 15/297,908

(22) Filed: Oct. 19, 2016

(65) Prior Publication Data

US 2017/0354202 A1 Dec. 14, 2017

(30) Foreign Application Priority Data

Jun. 13, 2016 (CN) ..... 2016 1 0414694

(51) Int. Cl.

| | |
|---|---|
| ***D05C 5/04*** | (2006.01) |
| ***D05C 17/00*** | (2006.01) |
| ***A43D 100/00*** | (2006.01) |
| ***A43B 23/02*** | (2006.01) |
| ***A43D 8/00*** | (2006.01) |
| ***A43B 7/06*** | (2006.01) |
| ***A43C 5/00*** | (2006.01) |

(52) U.S. Cl.

CPC ..... *A43B 23/0245* (2013.01); *A43B 7/06* (2013.01); *A43B 23/0205* (2013.01); *A43C 5/00* (2013.01); *A43D 8/00* (2013.01); *A43D 100/00* (2013.01); *D05C 5/04* (2013.01); *D05C 17/00* (2013.01)

(58) Field of Classification Search

CPC . D05C 5/04; D05C 17/00; A43D 8/00; A43D 100/00; A43C 5/00

USPC ..... 12/142 R, 146 C, 142 LC

See application file for complete search history.

(56) References Cited

U.S. PATENT DOCUMENTS 5,371,957 A * 12/1994 Gaudio ..... A43B 11/00 36/45
8,312,645 B2 * 11/2012 Dojan ..... A43B 3/26 36/45
8,844,167 B2 * 9/2014 Greene ..... A43B 23/025 36/45

(Continued)

*Primary Examiner* — Marie D Bays
(74) *Attorney, Agent, or Firm* — Harness, Dickey & Pierce, PLC.; Anthony G. Fussner

(57) ABSTRACT

A vamp with loop protection eyelets and a manufacture method thereof are disclosed. The vamp comprises a vamp body including a middle part having a notch which functions as a shoe tongue part. The vamp body is one-piece knitted fabric or a sheet-splice-vamp. Strings are projectively fixed on the upper surface of the vamp body. Threads embroider and fix the strings on the vamp body along a path of the length direction of the strings. The strings not only form a pattern on the vamp body but also leave loops on the shoe tongue part. Loops protrude inwards from both side edges of the shoe tongue part. The vamp has ventilation and has good supportability and straightness, is not only esthetic but also can protect feet. Protection eyelets are connected very firmly and do not come off easily. The pattern with a stereoscopic visual effect is formed on the vamp.

7 Claims, 4 Drawing Sheets

(56) References Cited

U.S. PATENT DOCUMENTS

| | | | | |
|---|---|---|---|---|
| 9,681,709 | B2 * | 6/2017 | Manz | A43D 117/00 |
| 2007/0271822 | A1 * | 11/2007 | Meschter | A43B 7/14 36/45 |
| 2011/0232008 | A1 * | 9/2011 | Crisp | A43B 9/00 12/18.1 |
| 2013/0323458 | A1 * | 12/2013 | Meschter | A43B 23/227 428/102 |
| 2013/0340283 | A1 * | 12/2013 | Bell | A43C 11/002 36/51 |
| 2015/0026937 | A1 * | 1/2015 | Nonogawa | A43C 1/00 24/713.4 |
| 2016/0058098 | A1 * | 3/2016 | Cross | A43B 1/04 36/9 R |
| 2017/0325547 | A1 * | 11/2017 | Cai | A43B 7/085 |
| 2017/0354202 | A1 * | 12/2017 | Cai | A43B 7/06 |

* cited by examiner

VAMP WITH LOOP PROTECTION EYELETS AND MANUFACTURE METHOD THEREOF

CROSS-REFERENCE TO RELATED APPLICATION

This application claims the benefit and priority of Chinese Invention Patent Application No. 201610414694.2 filed Jun. 13, 2016. The entire disclosure of the above application is incorporated herein by reference.

TECHNICAL FIELD

The present invention generally relates to shoemaking, and more specifically, to a vamp with loop protection eyelets and a manufacture method thereof.

BACKGROUND

This section provides background information related to the present disclosure which is not necessarily prior art.

Current shoes are more and more diverse. There are shoes with protection eyelets. The protection eyelets are used to pass a shoe lace through. Consequently, it is not necessary to arrange shoe eyelets on a vamp. At present, a protection eyelet is set on the vamp by a protection eyelet string. One end of the protection eyelet string is a loop protruding from the vamp, and the other end of the protection eyelet string is stitched on the side edge of the vamp and is adhered to the shoe sole. Such a protection eyelet string is set on the vamp by hand, and only the tail thereof is fixed. The protection eyelet string comes off easily, when a force is applied to it. Furthermore, by setting the string by hand, only some simple interweavement patterns can be done, and the product is simple and not standard and unified. There is also a case where a string is used to weave a mesh vamp integrally. In that case, when a vamp is woven, loops to pass a shoe lace through are woven integrally. However, though such a mesh vamp is ventile, it is very soft. The vamp has poor straightness and shaping ability. The vamp is not esthetic and cannot protect feet.

SUMMARY

This section provides a general summary of the disclosure, and is not a comprehensive disclosure of its full scope or all of its features.

With respect to the above mentioned problems existing in the prior art, the technical problem to be solved by the present invention is to provide a vamp with loop protection eyelets and a manufacture method thereof. It can ensure that connection between the protection eyelet and the vamp is firm, the vamp has ventilation and has good supportability and straightness, mechanized production is achieved, the product design is rich and standard and unified, the decorative pattern design is highly free.

The technical solutions of the present invention are as follows: a vamp with loop protection eyelets comprises a vamp body, the middle part of the vamp body has a notch which functions as a shoe tongue part, said vamp body is one-piece knitted fabric or a sheet-splice-vamp, strings are projectively fixed on the upper surface of said vamp body, threads embroider and fix the strings on the vamp body along a path of the length direction of said strings, said strings not only form a pattern on the vamp body, but also leave loops on said shoe tongue part, the loops protrude inwards from both side edges of the shoe tongue part.

Furthermore, in order to connect protection eyelets formed by the loops and the vamp more firmly, said shoe tongue part is embroidered with two layers by using strings, the first layer includes said loops, the loops connect the pattern formed by strings on the vamp body, and the second layer covers the strings of the first layer of the shoe tongue part.

Furthermore, in order to connect protection eyelets and the vamp more firmly and have more rich decorative effects, said strings are also cover-embroidered on the vamp body by threads, the threads densely embroider to form a pattern so as to cover a part of the strings, the pattern embroidered by the threads at least covers the strings of the shoe tongue part.

Furthermore, said vamp body is the sheet-splice-vamp, respective sheets of material are aligned and embroidered and connected. In this way, a variety of shoe materials may be adopted to manufacture the vamp. Besides the design and color and the hollowed-out shape of fabric being different, a part of sheet materials may also adopt leather to maintain a better shoe model and promote the protective function, the product design space is big. Embroidering and connecting sheet materials may be done while the strings are cover-embroidered. Splicing and cover-embroidering are finished at a time, the process is simple.

Furthermore, in order to ensure ventilation and appropriate straightness of the vamp, the whole or a part of said vamp body is knitted hollowed-out fabric, the lower portion of the vamp body is lined with a liner, threads which fix said strings extend through said liner, the threads embroider and connect the strings, the vamp body and the liner.

The present invention also provides a manufacture method of a vamp with loop protection eyelets, comprising the following steps:

(1) making electronic drawings, the electronic drawings including a vamp electronic drawing and an embroidery drawing;

(2) starting a plate band, performing a starting band design according to the embroidery drawing described in step (1), ensuring that the embroidery path of embroidery needle can embroider a pattern smoothly.

(3) according to the vamp electronic drawing made in step (1), fabricating a blank of the vamp body with a laser, the middle part of the blank having a notch which functions as a shoe tongue part, the notch connecting a shoe opening part located in the lower portion of the blank;

(4) passing strings and threads through the needle of an embroidery machine;

(5) embroidering the pattern on the upper surface of said blank according to said embroidery drawing by the needle of the embroidery machine, said pattern being formed by strings projecting on the blank, the strings being embroidered and fixed on the blank along a path of the length direction of said strings by threads, said strings leaving loops on said shoe tongue part, loops protruding inwards from both side edges of the shoe tongue part;

(6) again, processing the obtained semifinished vamp with laser, obtaining the finished product vamp shoe model.

The upper surface of said shoe tongue part is embroidered with two layers by said strings, the first layer includes said loops, the loops connect the pattern formed by strings on the vamp body, and the second layer covers the strings of the first layer of the shoe tongue part.

When embroidering in step (5), the lower surface of the blank is lined with a liner.

As an embodiment of splicing the vamp, said blank in step (3) includes several separate sheet components, also in step (3), said sheet components are spliced and located on the liner to form the vamp blank; in said step (5), after embroidering by strings, respective locations where sheets are spliced are embroidered and connected by threads, then the threads are used to cover a part of the strings to perform decorative embroidery, the pattern embroidered by the threads at least covers the strings of the shoe tongue part.

Furthermore, in order to ensure ventilation and appropriate straightness of the vamp, the whole or a part of the blank of said vamp body is knitted hollowed-out fabric.

In the present invention, embroidery is performed on the vamp body to form a pattern, the whole or a part of the vamp body is knitted hollowed-out fabric such as various warp knitted mesh cloth, a part of the shoe material may also adopt leather, the vamp has ventilation and has good supportability and straightness, is not only esthetic but also can protect feet; the pattern is constituted by the strings arranged on the vamp, threads follow the strings in the length direction of the strings and embroider the strings on the vamp, the strings leave loops as protection eyelets on the shoe tongue part, loops protrude inwards from both side edges of the shoe tongue part and are located within the notch of the shoe tongue part, the protection eyelets are formed by embroidering the strings integrally, the whole strings are stitched to the vamp except the loop protection eyelets, thereby connection between the loops and the vamp is very firm, the loops do not come off easily, the thicker strings form a pattern with a stereoscopic visual effect on the vamp, and if a layer of strings fixed by embroidering or a pattern formed by embroidering with threads is added in the shoe tongue part, the roots of the protection eyelets are reinforced again, and the design pattern is more rich and stereoscopic; moreover, the mechanized embroidery machine can weave rich patterns according to the embroidery drawing, fabricating protection eyelets, embroidering the pattern and connecting sheets are accomplished by embroidering at a time, the process is simple, mechanized production is achieved. The decorative pattern design is highly free, the product is more rich, the products manufactured are standard and unified.

The advantageous effects of the present invention are: the provided or manufactured vamp has ventilation and has good supportability and straightness, is not only esthetic but also can protect feet; locations where protection eyelets are connected are reinforced multiple times and are very firmly, the protection eyelets do not come off easily; fabricating protection eyelets, embroidering the pattern and connecting sheets are accomplished by embroidering at a time, the process is simple, fully mechanized production is achieved, the product design is more rich, the products manufactured are standard and unified.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Hereinafter, the present invention is described in further detail in conjunction with embodiments, but the present invention is not limited to the following embodiments.

Figure 1:
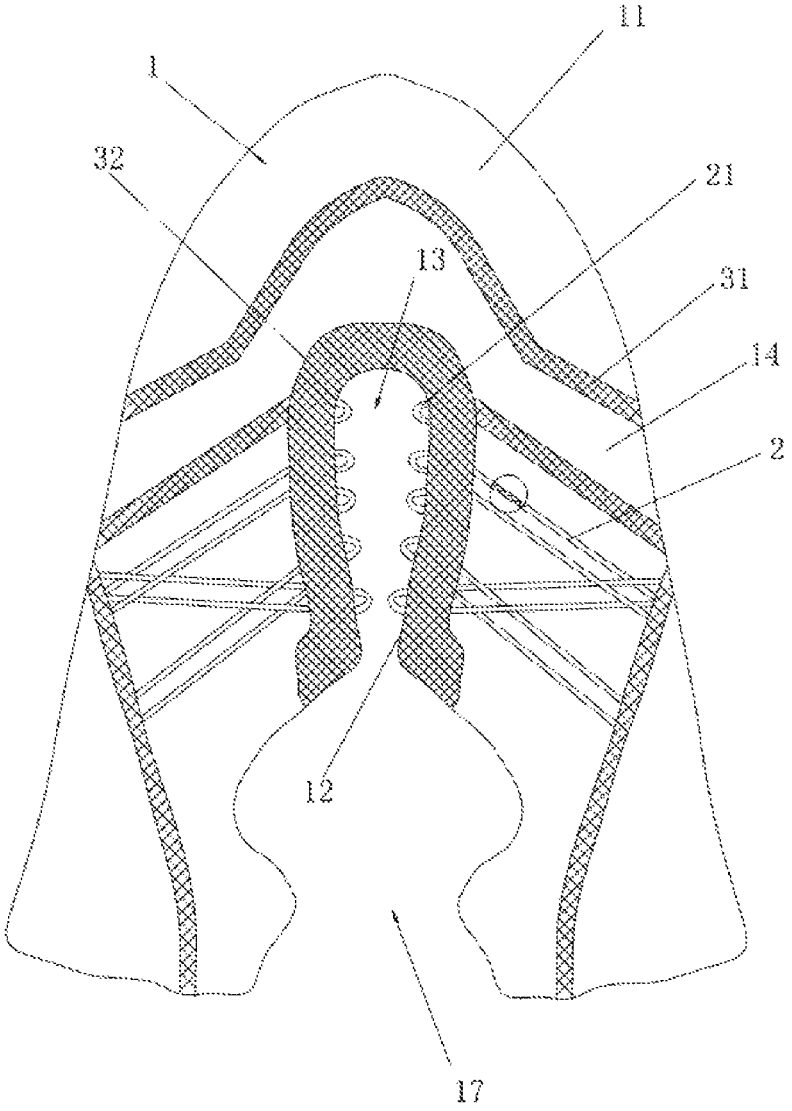
FIG. 1 is a structural diagram of an embodiment 1 of the present invention.
Figure 2:
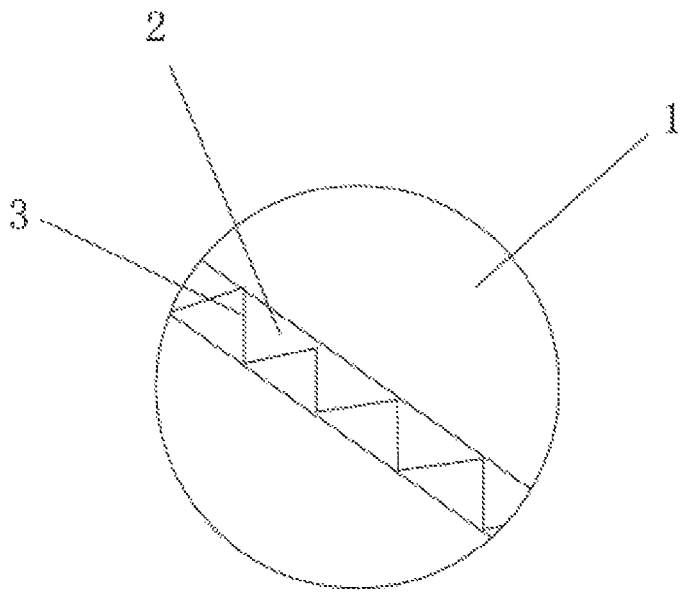
FIG. 2 is a partial enlarged view of FIG. 1.
Figure 3:
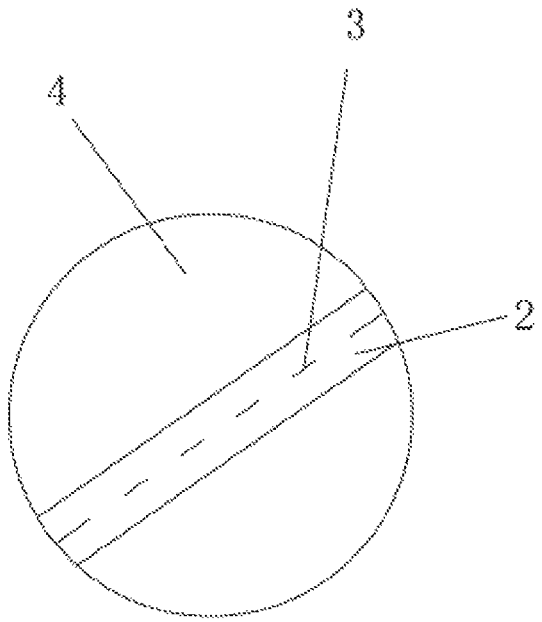
FIG. 3 is a rear view of FIG. 2.

Embodiment 1:

As shown in FIGS. 1 to 3, a vamp with loop protection eyelets includes a vamp body 1 in sheets, the front of the vamp body 1 is a circular arc shape which functions as a toe cap 11, the vamp body 1 become wide gradually along the direction from the toe cap 11 to a heel, the middle part of the vamp body 1 has a notch 13 which functions as a shoe tongue part 12, the notch 13 connects an opening 17 which functions as a shoe opening in the back portion. Said vamp body 1 is a sheet-splice-vamp, the vamp is formed by embroidering and splicing 6 sheets of material, a location where embroidering and splicing is done forms a band-shape pattern 31, the toe cap 11 adopts leather fabric, warp knitted mesh cloth with good ventilation is adopted as a ventilation region 14 between the toe cap 11 and the shoe tongue part 12, other material for shoes is warp knitted fabric. Strings 2 are projectively fixed on the upper surface of said vamp body 1, the strings 2 are distributed on the periphery of the shoe tongue part 12, and the strings 2 extend outwards from both sides of the shoe tongue part 12, forming a parallel or crossing line pattern. Threads 3 embroider and fix strings 2 on the vamp body 1 along a path of the length direction of said strings 2, strings 2 not only form the line pattern on the vamp body 1, but also leave loops 21 on said shoe tongue part 12, loops 21 protrude inwards from both side edges of the shoe tongue part 12 to from protection eyelets, two columns of loops 21 are located within the notch 13 of the shoe tongue part 12.

In order to connect protection eyelets and the vamp more firmly and have more rich decorative effects, said strings 2 are also cover-embroidered on the vamp body 1 by threads 3, the threads 3 densely embroider to form a pattern so as to cover a part of strings 2. It may be seen from FIG. 1 that, a a-shape pattern 32 embroidered by the threads surrounds the periphery of the shoe tongue part 12, and covers the strings 2 of the shoe tongue part 12. The lower portion of the vamp body 1 is lined with a liner 4, the threads 3 which fix the strings 2 extend through said liner 4, the threads 3 embroider and connect the strings 2, the vamp body 1 and the liner 4.

The above mentioned manufacture method of the vamp includes the following steps:

(1) making electronic drawings, the electronic drawings including a vamp electronic drawing and an embroidery drawing;

(2) starting a plate band, performing a starting band design according to the embroidery drawing described in step (1), ensuring that the embroidery path of embroidery needle can embroider the pattern smoothly.

(3) according to the vamp electronic drawing made in step (1), fabricating several sheet components constituting the blank of the vamp body 1 with a laser, then splicing and locating the sheet components, forming the vamp blank:

A. laying the liner 4 on the table of an embroidery machine; B, opening position, using the needle of the embroidery machine to perforating the liner 4 so as to obtain a shoe model having machining allowance; C. according to the shoe model formed by perforating, aligning and adhering the sheet components in corresponding positions on the liner 4;

(4) passing strings 2 and threads 3 through the needle of the embroidery machine;

(5) first, embroidering the strings 2 on located sheet components by the threads 3, leaving loops 21 as protection eyelets, then embroidering and connecting respective locations where sheets are spliced by the threads 3, then using threads 3 to densely embroider to form a pattern so as to cover a part of strings 2, performing decoration and fixation again, a a-shape pattern 32 embroidered by the threads covering the strings 2 of the shoe tongue part 12;

(6) again, processing the semifinished vamp obtained in step (5) with laser, removing the redundant part of the edge, obtaining the finished product vamp shoe model.

Figure 4:
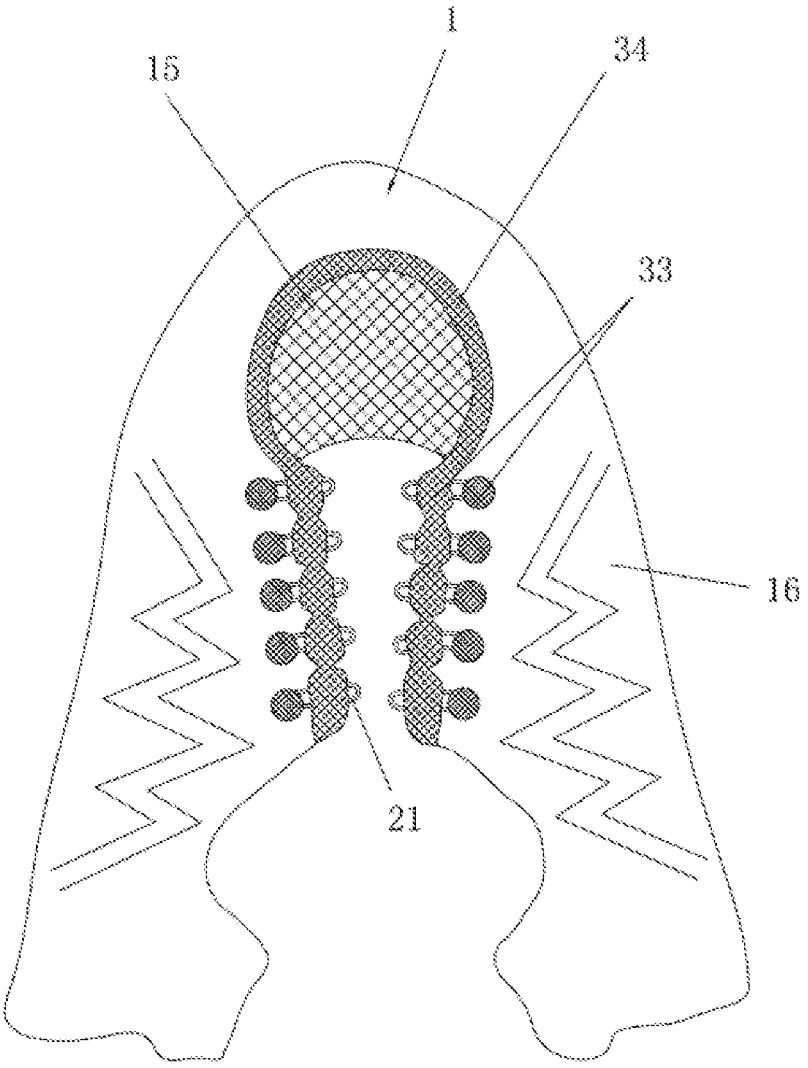
FIG. 4 is a structural diagram of an embodiment 2 of the present invention.

Embodiment 2:

As shown in FIG. 4, the vamp provided by the present embodiment is basically identical to that in the embodiment 1, with the exception that sheet components constituting the vamp body 1 are only two pieces of knitted fabric, a piece of warp knitted mesh cloth 15 with large meshes is in the front of the shoe tongue part 12, the rest of the sheet components are jacquard mesh cloth 16. Strings 2 are distributed in S shapes at the periphery of the shoe tongue part 12, threads 3 form a plurality of circular patterns 33 to cover-embroider the strings 2 on the periphery of the shoe tongue part 12, and threads 3 continuously embroider and splice two sheet components together, the location where splicing is done forms a circular embroidery pattern 34.

Figure 5:
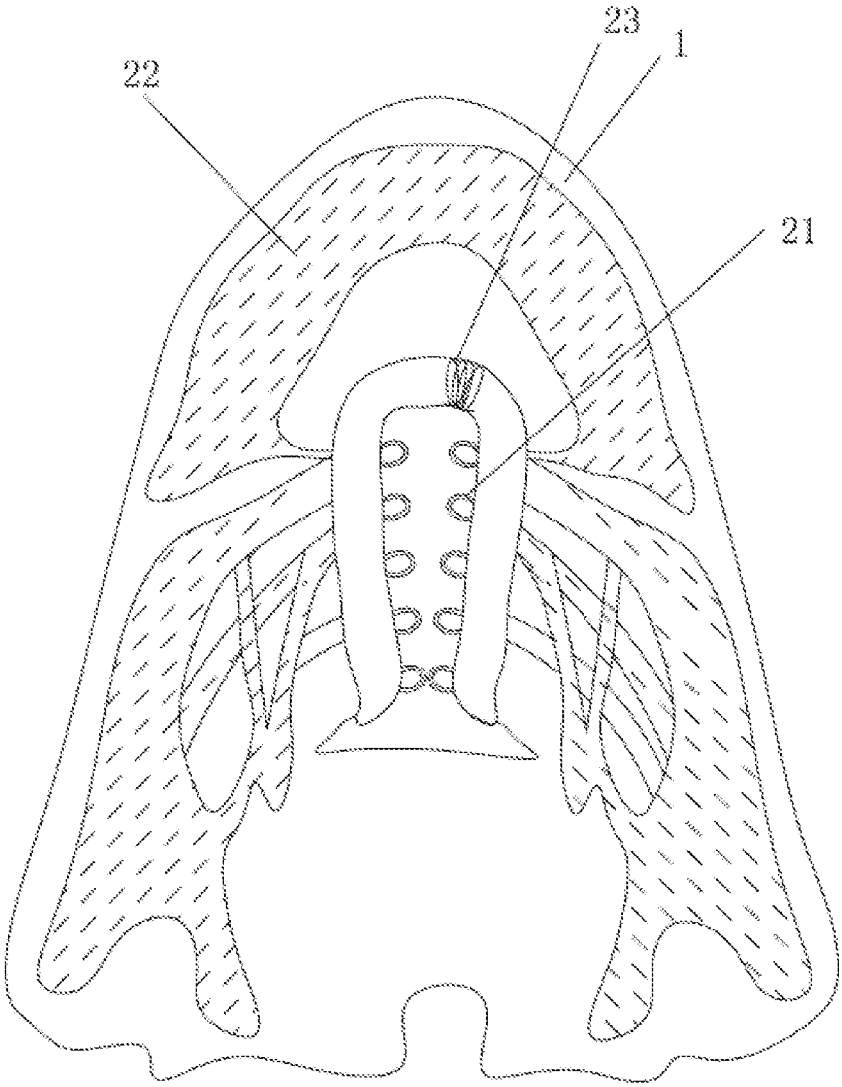
FIG. 5 is a structural diagram of an embodiment 3 of the present invention.

Embodiment 3:

As shown in FIG. 5, the vamp provided by the present embodiment is basically identical to that in the embodiment 1, with the exception that the vamp body 1 is one-piece knitted fabric, the present embodiment adopts warp knitted mesh cloth, the warp knitted mesh cloth is well ventile and has certain supportability and straightness, the lower portion of the vamp body 1 is lined with the liner 4 (see FIG. 3 for the liner 4), the upper surface of the vamp body 1 is embroidered by using strings 2, strings 2 make a string pattern 22 on the upper surface of the vamp, and at the same time, leave loops 21 as protection eyelets, the string pattern 22 occupies the most part of the area of the vamp body 1, it not only decorates the vamp body 1 but also improves the stiffness of the vamp body 1. The upper surface of the shoe tongue part 12 is embroidered with two layers by using strings 2, the first layer includes said loops 21 as protection eyelets, loops 21 connect the string pattern 22 formed by strings 2 on the vamp body 1, and strings 2 of the second layer cover the strings 2 if the first layer. It may be seen from FIG. 5 that, strings 2 form continuous elliptical loops 23 to cover the shoe tongue part 12, elliptical loops 23 partially overlap, each covers another, this reinforces the fixation of the roots of protection eyelets, moreover, the shoe tongue part 12 is also further shaped and reinforced.

The manufacture method of the present embodiment is different from the embodiment 1 only in that step (3) and step (5) are simplified. In step (3), directly according to the vamp electronic drawing made in step (1), the blank of the vamp body 1 is fabricated with the laser, but the shoe opening of the blank is not cut in order to facilitate embroidering and prevent deforming; in step (5), a pattern is embroidered on the upper surface of the blank according to the embroidery drawing by the needle of the embroidery machine, the pattern is formed by the strings 2 projecting on the blank, the strings 2 are embroidered and fixed on the blank along a path of the length direction of said strings 2 by the threads 3, said strings 2 leave loops 21 on said shoe tongue part 12, loops 21 protrude inwards from both side edges of the shoe tongue part 12, the upper surface of the shoe tongue part 12 is embroidered with two layers by using strings 2, the strings 2 of the second layer form continuous elliptical loops 23 to cover the shoe tongue part 12, and at the same time, cover the strings 2 of the first layer.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations in use or operation in addition to the orientation depicted in the figures. For example, if figures are turned over, elements described as "below" or "beneath" other elements or features would then be oriented "above" the other elements or features. Thus, the example term "below" can encompass both an orientation of above and below. An exemplary embodiment may be otherwise oriented (rotated 90 degrees or at other orientations) and the spatially relative descriptors used herein interpreted accordingly.

The above are only preferred embodiments of the present invention, but the protection scope of the present invention is not limited thereto. Any modifications, equivalent substitutions, improvements, etc., made within the spirit and principle of the present invention are to be contained within the protection scope of the present invention.

The invention claimed is:

1. A manufacture method of a vamp with loop protection eyelets, comprising the following steps:

(1) making electronic drawings, the electronic drawings including a vamp electronic drawing and an embroidery drawing;

(2) starting a plate band, performing a starting band design according to the embroidery drawing described in step (1), ensuring that the embroidery path of an embroidery needle can embroider a pattern smoothly;

(3) according to the vamp electronic drawing made in step (1), fabricating a blank of a vamp body with a laser, a middle part of the blank having a notch which functions as a shoe tongue part, the notch connecting a shoe opening part located in a lower portion of the blank;

(4) passing strings and threads through a needle of an embroidery machine;

(5) embroidering the pattern on an upper surface of said blank according to said embroidery drawing by the needle of the embroidery machine, said pattern being formed by strings projecting on the blank, the strings being embroidered and fixed on the blank along a path of a length direction of said strings by threads, said strings leaving loops on said shoe tongue part, the loops protruding inwards from both side edges of the shoe tongue part; and (6) again, processing the obtained semifinished vamp with laser, obtaining a finished product vamp shoe model.

2. The manufacture method of the vamp with loop protection eyelets according to claim 1, wherein:

the upper surface of said shoe tongue part is embroidered with first and second layers by said strings;

the first layer includes said loops;

the loops connect the pattern formed by strings on the vamp body; and the second layer covers the strings of the first layer of the shoe tongue part.

3. The manufacture method of the vamp with loop protection eyelets according to claim 1, wherein when embroidering in step (5), a lower surface of the blank is lined with a liner.

4. The manufacture method of the vamp with loop protection eyelets according to claim 2, wherein when embroidering in step (5), a lower surface of the blank is lined with a liner.

5. The manufacture method of the vamp with loop protection eyelets according to claim 1, wherein: said blank in step (3) includes several separate sheet components, also in step (3), said sheet components are spliced and located on a liner to form the blank of said vamp body; in said step (5), after embroidering by strings, respective locations where sheets are spliced are embroidered and connected by threads, then the threads are used to cover a part of the strings to perform decorative embroidery, the pattern embroidered by the threads at least covers the strings of the shoe tongue part.

6. The manufacture method of the vamp with loop protection eyelets according to claim 1, wherein the whole or a part of the blank of said vamp body is knitted hollowed-out fabric.

7. The manufacture method of the vamp with loop protection eyelets according to claim 5, wherein the whole or a part of the blank of said vamp body is knitted hollowed-out fabric.

* * * * *